US009837237B2

(12) United States Patent
Lozano et al.

(10) Patent No.: US 9,837,237 B2
(45) **Date of Patent: *Dec. 5, 2017**

(54) PYROLYZED POROUS CARBON MATERIALS AND ION EMITTERS

(71) Applicant: Massachusetts Institute of Technology, Cambridge, MA (US)

(72) Inventors: Paulo C. Lozano, Arlington, MA (US); Carla Perez Martinez, Oxford (GB); Corey P. Fucetola, Somerville, MA (US); Jimmy Andrey Rojas Herrera, Palo Alto, CA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/608,761

(22) Filed: May 30, 2017

(65) Prior Publication Data

US 2017/0263408 A1 Sep. 14, 2017

Related U.S. Application Data

(63) Continuation of application No. 15/179,675, filed on Jun. 10, 2016, now Pat. No. 9,704,685.

(60) Provisional application No. 62/174,143, filed on Jun. 11, 2015.

(51) Int. Cl.

| | |
|---|---|
| ***H01J 1/304*** | (2006.01) |
| ***H01J 3/04*** | (2006.01) |
| ***H01J 9/02*** | (2006.01) |

(52) U.S. Cl.
CPC ..... *H01J 1/304* (2013.01); *H01J 3/04* (2013.01); *H01J 9/025* (2013.01)

(58) Field of Classification Search
CPC ..... H01J 1/304; H01J 9/025; H01J 3/04
See application file for complete search history.

(56) References Cited

U.S. PATENT DOCUMENTS

| | | | | |
|---|---|---|---|---|
| 6,297,499 | B1 | 10/2001 | Fenn | |
| 9,704,685 | B2 | 7/2017 | Lozano et al. | |
| 2004/0245457 | A1* | 12/2004 | Granger | H01J 49/165 250/288 |
| 2005/0127814 | A1* | 6/2005 | Deguchi | B82Y 10/00 313/495 |
| 2005/0269559 | A1 | 12/2005 | Zhou et al. | |
| 2010/0072394 | A1* | 3/2010 | Kertesz | H01J 49/165 250/424 |
| 2011/0210265 | A1 | 9/2011 | Lozano et al. | |
| 2012/0144796 | A1 | 6/2012 | Marrese-Reading | |
| 2014/0054809 | A1* | 2/2014 | Lozano | H01J 37/08 264/28 |

OTHER PUBLICATIONS

International Search Report and Written Opinion for PCT/US2016/036928 dated Oct. 24, 2016.

(Continued)

*Primary Examiner* — Donald Raleigh
(74) *Attorney, Agent, or Firm* — Wolf, Greenfield & Sacks, P.C.

(57) ABSTRACT

Embodiments related to the use and production of porous carbon materials in ion emitters and other applications are described.

23 Claims, 14 Drawing Sheets

(56) References Cited

OTHER PUBLICATIONS

Alegre et al., Tailoring synthesis conditions of carbon xerogels towards their utilization as Pt-catalyst supports for oxygen reduction reaction (ORR). Catalysts. 2012;2:466-89.
Arestie, Porous material and process development for electrospray propulsion applications. Thesis, Massachusetts Institute of Technology, Jun. 2014. http://hdl.handle.net/1721.1/90652.
Baumann et al., High surface area carbon aerogel monoliths with hierarchical porosity. J Non-Crystalline Solids. 2008;354:3513-5.
Brandt et al., Acetic acid catalyzed carbon aerogels. J Porous Mat. 2003;10:171-8.
Courtney et al., Emission measurements from planar arrays of porous ionic liquid ion sources. J Phys D: Appl Physics. 2012;45:485203, 13 pages.
Dandavino et al., Microfabricated electrospray emitter arrays with integrated extractor and accelerator electrodes for the propulsion of small spacecraft. J Micromech Microeng. 2014;24:075011, 1-13.
Gross et al., Thermal expansion of carbon and silica aerogels above room temperature. J Non-Crystalline Solids. 1995;186:301-8.
Kong et al., Synthesis of monolithic mesoporous silicon carbide from resorcinol-formaldehyde/silica composites. Mat Letts. 2013;99:108-10.
Krpoun et al., Tailoring the hydraulic impedance of out-of-plane micromachined electrospray sources with integrated electrodes. Applied Physics Letters. 2009;94:163502-1--163502-3.
Legge et al., Electrospray propulsion based on emitters microfabricated in porous metals. J Propulsion and Power. Mar.-Apr. 2011;27(2):485-95.
Mezzavilla et al., Carbon xerogels as electrodes for supercapacitors. The influence of the catalyst concentration on the microstructure and on the electrochemical properties. J Mater Sci. 2012;47:7175-80.
Van Berkel et al., Efficient analyte oxidation in an electrospray ion source using a porous flow-through electrode emitter. J Am Soc Mass Spectrom. Dec. 2004;15(12):1755-66.

* cited by examiner

PYROLYZED POROUS CARBON MATERIALS AND ION EMITTERS

CROSS-REFERENCE TO RELATED APPLICATIONS

This application is a continuation of U.S. application Ser. No. 15/179,675, filed on Jun. 10, 2016, which claims the benefit of priority under 35 U.S.C. §119(e) of U.S. provisional application Ser. No. 62/174,143, filed Jun. 11, 2015, the disclosures of each of which are incorporated by reference herein in their entireties.

GOVERNMENT LICENSE RIGHTS

This invention was made with Government support under Grant No. FA2386-14-1-4067 awarded by the Asian Office of Aerospace Research and Development. The Government has certain rights in the invention.

FIELD

Disclosed embodiments are related to pyrolyzed porous carbon materials and ion emitters.

BACKGROUND

Xerogels and aerogels are special classes of low-density open-cell foams with large internal void fractions (i.e. porosity). This leads to useful material properties such as high surface area to volume ratios, low thermal conductivity (2-3 orders of magnitude less than silica glass), and high acoustic impedance. Correspondingly, these materials have been used in applications such as thermal and acoustic insulation, catalysis, gas filters, gas storage, electrodes for electrochemical devices such as super capacitors and batteries, as well as micro fluidics to name a few.

SUMMARY

In one embodiment, an ion emitter includes a porous carbon emitter body and a source of ions in fluid communication with the porous emitter body.

In another embodiment, an array of ion emitters includes a substrate and a plurality of porous carbon emitter bodies disposed on the substrate. Further, a source of ions is in fluid communication with the plurality of porous emitter bodies through the substrate.

In yet another embodiment, a method of forming a porous carbon material includes: placing a solution into a mold cavity having a ratio of exposed surface area to volume from 10.5 to 13.5; curing the solution to form a sol-gel; drying the sol-gel to form a porous material; and pyrolyzing the a porous material to form the porous carbon material.

In another embodiment a material includes porous carbon having a mean pore radii from 100 nm to 1 μm with a standard deviation of the mean pore radii is from 10 nm to 70 nm.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
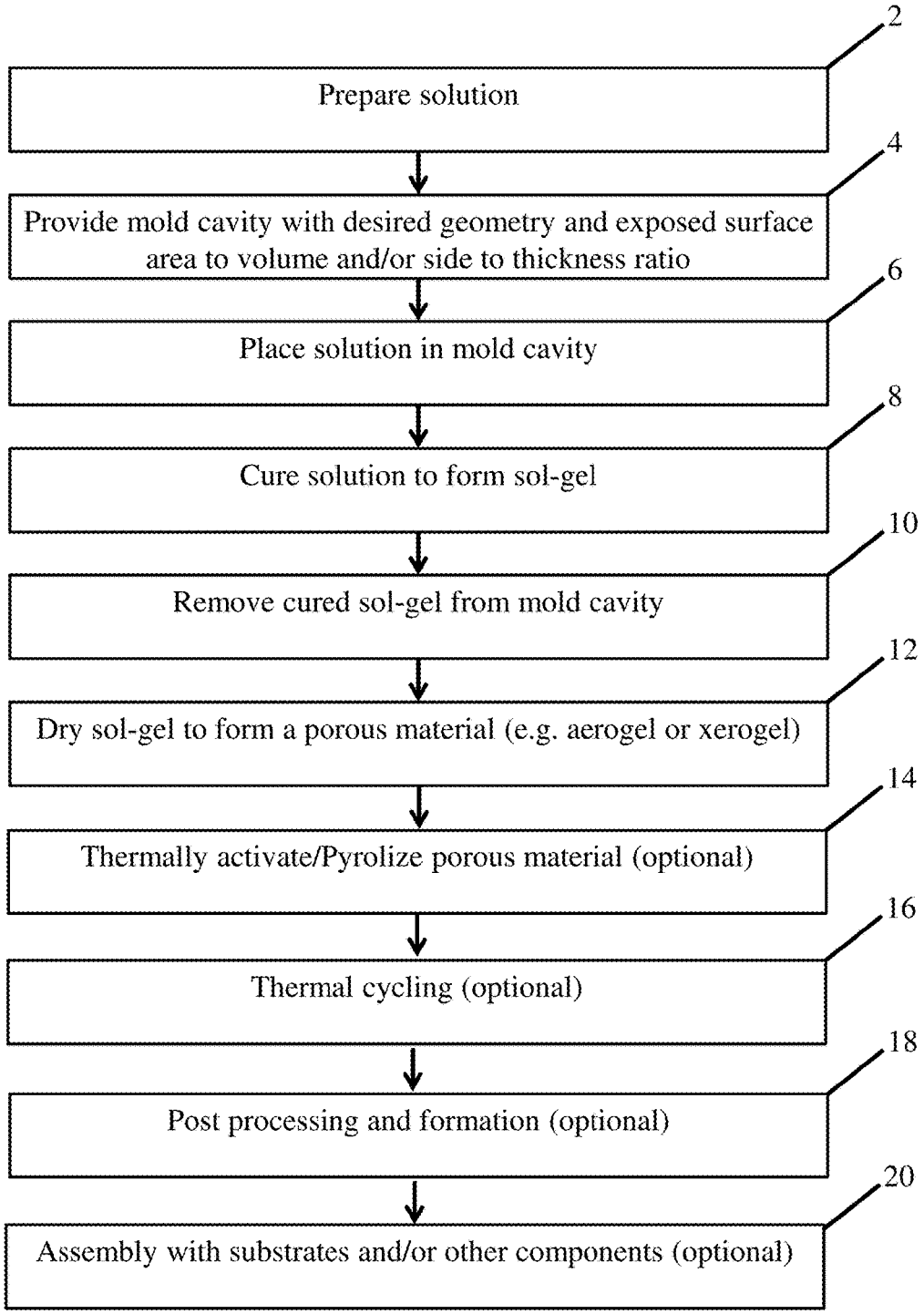
FIG. 1 is a schematic flow diagram of a method for forming a porous carbon material.

There are a number of different materials and configurations used for ion emitters. For example, externally wetted ion emitters are used for a number of ionic liquids thanks to the comparatively higher hydraulic impedance of this configuration. However, externally wetted emitters may suffer from uneven features near the emitter apex and poor wetting leading to interruptions in the liquid supply during prolonged operation. Porous tungsten, and other metal based, emitters are also used which provide redundancy of supply paths and protect the ionic liquid within the porous structure. However, porous metals emitters are usually sintered from relatively large and polydisperse powder populations which makes it difficult to shape these materials into sharp structures where the pore size remains relatively small compared to the radius of curvature of the structure tip. Moreover, the nonuniform distribution of pore and particle sizes in sintered porous materials translates into emitters with nonuniform shapes and microstructures which may result in emitters that operate in a mixed emission mode instead of a pure ionic regime.

In view of the above, the Inventors have recognized that in contrast to externally wetted and sintered metal materials, porous carbon materials, which in some embodiments may correspond to chemically synthesized materials such as a xerogel and/or aerogel, offer many benefits when used to form an ion emitter or other appropriate device. For example, in some embodiments, porous carbon materials formed using the methods disclosed herein may exhibit enhanced pore uniformities, may be easy to machine by both additive and subtractive processes, and may be well-wetted by ionic liquids.

In addition to the above, in some embodiments, it may be desirable to control the pore size and material porosity of a porous carbon material to provide one or more desired fluid transport properties, emission behavior of a particular emitter, and/or other desirable property for a particular application. However, pore size and porosity of porous carbon materials is typically modified by controlling the chemical concentrations of the materials used to form the material, but controlling the pore size and porosity of the material becomes very sensitive to changes in concentration for mean pore radii on the order of several nanometers (mesopores) to several micrometers (macropores). Accordingly, the Inventors have recognized it may be desirable to use a more controllable method to produce porous carbon materials with a desired mean pore radii and porosity. In view of the above, the Inventors have recognized the benefits associated with using mold cavity geometries during a curing and/or drying process to control the pore size and porosity of a porous material over a range of size scales as detailed further below. Further, in some embodiments, depending on what materials the porous material comprises, the porous material may subsequently be pyrolized to turn the porous material into a porous carbon material.

As detailed further below, mold cavity geometries can be used to control the pore size and/or porosity of a material formed in the mold. For example, a particular mold geometry with a desired ratio of dimensions may be selected to provide a desired pore size and/or porosity. In one such embodiment, a mold cavity geometry may have an exposed surface area to volume ratio greater than or equal to 10.5, 11, 11.5, 12, or any other appropriate ratio. Correspondingly, the mold cavity geometry may have an exposed surface area to volume ratio less than or equal to 13.5, 13, 12.5, 12, 11.5, or any other appropriate ratio. Combinations of the above ranges are contemplated including, for example, an exposed surface area to volume ratio from 10.5 to 13.5 as well as 11 to 13.

While one particular type of ratio is noted above, in some applications it may be desirable to use a mean side to depth ratio of a mold cavity to provide a desired pore size and/or porosity for a material formed in the mold. In one such embodiment, a mold cavity geometry may have a mean side to depth ratio greater than or equal to 2, 2.5, 3, 3.1, 3.2, 3.3, 3.5, or any other appropriate ratio. Correspondingly, the mold cavity geometry may have a mean side to depth ratio greater than or equal to 4, 3.9, 3.8, 3.7, 3.6, 3.5, or any other appropriate ratio. Combinations of the above ranges are contemplated including, for example, a mean side to depth ratio from 2 to 4, 3 to 4, as well as 3.3 to 3.6 may be used.

While particular ranges for the surface area to volume ratios as well as the mean side to depth ratio have been given above, it should be understood that the general concept of controlling an exposed amount of surface area to material volume for controlling a pore size of a material may be applied in any number of different material systems and/or applications. Additionally, depending on the particular types of materials used to form the solutions, processing parameters used to cure the solution to form a sol-gel (i.e. temperature, time, catalyst, viscosity, etc.), the particular ratios used to form a desired pore size may change. Consequently, it should be understood that ratios both greater than and less than those noted above may also be used as the current disclosure is not limited in this fashion.

In addition to the above noted ratios, the formation of pores may be influenced by typical sol-gel processing parameters such as temperature, pH, concentration of reactants, and other appropriate processing parameters. Therefore, in addition to controlling the geometry of a mold cavity, it may be desirable to simultaneously control one or more of the above noted processing parameters. For example, the temperature, pH, and/or concentration of reactants may be selected to provide a pore sizes and/or porosities within a certain range and the mold cavity geometry may be selected to further refine and control the pore size and/or porosity of the final resulting material.

Depending on the final application, such as in ion emitters, after forming a porous material, the porous material may be subjected to a pyrolization step. Therefore, in some embodiments, a porous material is heated to an elevated temperature under an appropriate atmosphere that is substantially inert relative to the materials and resulting carbon material over the applied pyrolization temperatures. Appropriate gases include, but are not limited to, helium, neon, argon, krypton, xenon, as well as nitrogen (with appropriate temperature limits to avoid reaction) to name a few. During pyrolization, the non-carbon components of the material are converted into gas and removed from the porous material leaving carbon behind. Therefore, after the pyrolization step, the porous material has been converted into a carbon porous material. Appropriate pyrolization temperatures may range from 500° C. to any appropriate temperature less than the sublimation or melting temperature of carbon depending on the pressure. However, in most applications a pyrolization temperature may be from about 500° C. to 2000° C., 800° C. to 1500° C., 900° C. to 1100° C. However, it should be understood that any temperature capable of pyrolizing the particular material to form carbon may be used as the disclosure is not limited to any particular range of pyrlolization temperatures. The duration for a pyrolization step will depend on the temperature, material, and size of the component being pyrolized. However, appropriate pyrolization times may be from 30 minutes to 2 hours, 1 hour to 3 hours, or any other appropriate duration as the disclosure is not so limited.

It should be understood that any appropriate sol-gel may be used to form the described chemically synthesized porous materials, such as aerogels and/or xerogels. Further, in some embodiment, the porous material may be an organic porous material such as an organic aerogel and/or xerogel prior to undergoing pyrolization. Therefore, a sol-gel used in the processes described herein may be formed using one or more of resorcinol formaldehyde, phenol formaldehyde, melamine formaldehyde, cresol formaldehyde, phenol furfuryl alcohol, polyacrylamides, polyacrylonitriles, polyacrylates, polycyanurates, polyfurfural alcohol, polyimides, polystyrenes, polyurethanes, polyvinyl alcohol dialdehyde, epoxies, agar agar, agarose, and/or any other appropriate material as the disclosure is not so limited. Appropriate catalysts that may be used with the above noted reactants include, but are not limited to, acetic acid, sodium carbonate ($Na_2CO_3$), $[Pt(NH_3)_4]Cl_2$, $PdCl_2$, or ($AgOOC\pm CH_3$), $HClO_4$, $HNO_3$, HCl, $K_2CO_3$, $KHCO_3$, $NaHCO_3$, and/or any other appropriate catalyst as the disclosure is not so limited. In one specific embodiment, resorcinol and formaldehyde may be combined in water with acetic acid to form a sol-gel. While any appropriate concentrations of these reactants and catalyst within water, or other appropriate solvent, may be used, in one embodiment the solution may include from 30 molar to 40 molar resorcinol, 10 molar to 20 molar formaldehyde, and 0.25 molar to 1 molar acetic acid. Of course different concentrations of the above reactants and catalysts, both larger and smaller than those noted above, as well as the use of different types of reactants and catalysts, are also contemplated as the disclosure is not so limited.

Using the above noted materials and methods, a porous carbon material may be produced with a mean pore radii that is greater than or equal to 10 nm, 50 nm, 100 nm, 200 nm, 300 nm, 400 nm, 500 nm, or any other desirable size. Correspondingly, a porous carbon material may have a mean pore radii that is less than or equal to 1 μm, 900 nm, 800 nm, 700 nm, 600 nm, 500 nm, or any other desirable size. Combinations of the above ranges are contemplated including from 10 nm to 1 μm, 100 nm to 1 μm as well as from 200 nm to 800 nm. Of course porous carbon materials having mean pore radii both larger and smaller than those ranges noted above are also contemplated as the disclosure is not so limited.

"Porous," as used herein, is generally given its ordinary meaning in the art, further defined as follows. A porous material as used herein may refer to either an open cell and/or closed cell porous material with a plurality of pores formed within a bulk of the material. In a closed cell material, a plurality of isolated pores are formed within a bulk of the material where a majority of the pores are not interlinked with one another. Correspondingly, an open cell material may include interlinked pores extending throughout a bulk of the material such that a majority of the pores may be interlinked with one another. Of course, materials in which closed pores as well as interlinked pores, e.g. an open cell porous material including one or more pores isolated form the interlinked network of pores, are also contemplated as the disclosure is not so limited. Additionally, it should be understood that a degree of interlinking of the network of pores will vary as a function of the porosity of the material, and that the current disclosure is not limited by what degree the pore network is or is not interlinked.

In addition to mean pore radii, a porous carbon material formed using the methods disclosed herein may be more uniform than may be achievable using other methods. For example, in some applications, it may be desirable for three standard deviations of the mean pore radii to be from about 100 nm to 200 nm. Therefore, a standard deviation of a mean pore radii of a porous carbon material may be greater than or equal to 10 nm, 20 nm, 30 nm, 40 nm, and other appropriate length scale. The standard deviation of the mean pore radii may also be less than or equal to 70 nm, 60 nm, 50 nm, 40 nm, 30 nm, or any other appropriate length scale. Combinations of the above ranges, including, for example, a standard deviation from about 10 nm to 70 nm as well as 30 nm to 60 nm are contemplated. However, it should be understood that porous carbon materials having uniformities both greater than and less than those noted above are possible as the disclosure is not so limited.

Depending on the particular processing parameters and solution compositions, a porous carbon material may have any number of different porosities. For example, a porous carbon material may have a porosity that is greater than or equal to 20%, 30%, 40%, 50%, 60%, or any other appropriate porosity. The porosity of the porous carbon material may also be less than or equal to 80%, 70%, 60%, 30%, or any other appropriate porosity. Therefore, a porous carbon material may have porosities from 20% to 80%. Of course, porous carbon materials with porosities both greater than and less than those noted above are also contemplated.

It should be understood that any number of different methods may be used to measure both the porosity and/or mean pore radii of a material. However, appropriate methods for measuring the mean radii of a porous material include, but are not limited to the "bubble test", optical and scanning electron microscopy measurement and estimation techniques, mercury porosimetry and any other appropriate measurement and/or estimation technique. Additionally, appropriate methods for measuring a porosity of an open pore material include, but are not limited to measuring the outer dimensions and weight for bulk samples coupled with the known density of carbon, optical and scanning electron microscopy measurement and estimation techniques, mercury porosimetry, gravimetric measurements and any other appropriate measurement and/or estimation technique.

In addition to the above, the Inventors have recognized that porous carbon materials formed with the disclosed methods herein may exhibit thermal expansion hysteresis where the thermal expansion curves of the material between heating and cooling cycles have a very noticeable discrepancy. Depending on the particular application this thermal expansion hysteresis may lead to fracturing and/or delamination of the material from a corresponding substrate it is disposed on. For example, this may be of concern when coupling the porous carbon materials with a substrate as might occur when either bonding an array of emitters to a substrate and/or monolithically forming an array of emitters on a substrate. Additionally, in some applications it may be desirable to match the thermal expansion of the porous carbon material to one or more associated components for functional purposes. Therefore, in some embodiments, it may be desirable to reduce the thermal expansion hysteresis of a porous carbon material. Accordingly to reduce the thermal expansion hysteresis, in one embodiment, a porous carbon material is taken through one or more thermal cycles to reduce the observed thermal expansion hysteresis to below a desired threshold thermal expansion hysteresis.

A threshold thermal expansion hysteresis may be equal to any desirable limit. However, in one embodiment, the threshold thermal expansion hysteresis may be less than or equal to 10%, 5%, 4%, 3%, 2%, 1%, or any other appropriate percentage. Additionally, thermal cycling for a particular porous carbon material may be continued until the observed thermal expansion hysteresis is less than or equal to the desired threshold. In general, for purposes of this application, the residual amount of thermal expansion hysteresis in a material may be evaluated by thermally cycling the material between 20° C. and 500° C. at a constant heating and cooling rate of 8° C./min (i.e. one hour constant heating to 500° C. and one hour constant cooling to 20° C.). Due to the size dependent nature of thermal equilibration within a block of material, samples used in the above noted thermal cycling may have dimensions of about 1 $cm^2$ by 1 mm or any other appropriate combination of dimensions that provide a sample with a volume of about 0.1 $cm^3$ for testing. Of course, samples having both larger and smaller dimensions than those noted above may also be used so long as there is not an overly large thermal gradient across the material during testing as the disclosure is not so limited.

While a particular testing process has been listed above for general materials testing, for evaluating the use of a particular material in a specific application, other standards for determining an appropriate hysteresis for that particular application may be established as determined by appropriate design considerations. For example, in some applications, it may be desirable for a porous carbon material's thermal expansion hysteresis to be less than or equal to the above-noted ranges for a material thermally cycled between a first lower operating temperature and a second higher operating temperature.

When thermally cycling a porous carbon material the material may be cycled between at least a first and second temperature during each thermal cycle. However, multiple heating steps between the first and second temperatures may also be used, as the disclosure is not so limited. For example, the porous carbon material may be heated to one or more intermediate temperatures between the first and second temperatures and held for a desired amount of time before heating to the next intermediate or final temperature of the thermal cycle. Appropriate temperatures for both the intermediate and/or the higher second temperature may be greater than or equal to 100° C., 200° C., 300° C., 400° C., 500° C., or any other appropriate temperature. Similarly the intermediate and/or the higher second temperature may be less than or equal to 1500° C., 1200° C., 1000° C., 900° C., 800° C., 700° C., 600° C., 500° C., or any other appropriate temperature. The first lower temperature may also be greater than or equal to room temperature (typically about 20° C. or whatever particular environment the process occurs in), 100° C., 200° C., or any other appropriate temperature. The first lower temperature may also be less than or equal to 300° C., 200° C., 100° C., or any other appropriate temperature. Further, combinations of the above ranges for the different variables may be used. For example, one or more thermal cycles may be conducted using a first temperature between room temperature and 100° C. and a second temperature from about 500° C. to 1500° C. Further, in some instances one or more intermediate temperatures may be from about 200° C. to 1000° C. Of course temperatures both larger and smaller than those noted above may also be applied as the disclosure is not so limited.

The above noted temperature ranges applied during a thermal cycle of a porous carbon material may be held for any appropriate duration and/or heating rate sufficient to reduce the experienced thermal expansion hysteresis of the material. Additionally, in some embodiments, the porous carbon material may be held at a one or more intermediate temperatures such as every 50° C., 100° C., 200° C., 300° C., or other appropriate temperature interval. Further the materials may be held at these one or more intermediate temperatures for a time sufficient to avoid thermal fracturing of the material during the cycle. While the appropriate times will vary depending on the particular temperatures used and the materials being cycled, in one embodiment, the time durations of the various steps may be greater than or equal to 5 minutes, 10 minutes, 30 minutes, or any other appropriate time duration. The time duration may also be less than or equal to 1 hour, 30 minutes, 10 minutes, or any other appropriate time duration. Combinations of the above are also contemplated including time durations from 5 minutes to 1 hour. Of course, time durations for the various steps during a thermal cycle both larger and smaller than those noted above are also possible as the disclosure is not so limited. Additionally, embodiments in which a thermal cycle is conducted at a sufficiently slow heating rate that rest times at intermediate temperatures are not necessary are also contemplated as the disclosure is not so limited.

While the above embodiments have been directed to producing a porous carbon material for use with an ion emitter, it should be understood that the porous materials, porous carbon materials, as well as their methods of manufacture, may be used for other applications as well. For example, the porous materials and porous carbon materials described herein may be used in high performance liquid chromatography, thermal insulation, acoustic insulation, catalysis, gas filters, micro fluidics, propulsion, gas storage (e.g. hydrogen storage), electrodes for electrochemical devices (e.g. supercapacitors, batteries, etc), desalination, and electrochemistry to name a few.

Turning now to the figures, several non-limiting embodiments are described in further detail. Of course, it should be understood that the various methods, components, and systems described in relation to these figures may be combined in any appropriate fashion as the disclosure is not so limited.

FIG. 1 presents a flow diagram of a process for forming a porous material, such as an aerogel or xerogel, that may be subsequently pyrolized and used in a device. In the depicted process, a solution is prepared by mixing the appropriate reactants and catalyst in any appropriate proportion for a desired application at 2. At 4, a mold cavity is provided with a desired geometry for a particular application. Appropriate mold cavity geometries include, but are not limited to, cubic, partial spheres, conical, rectangular prisms, and/or any other appropriate geometry including complex geometries combining multiple shapes and features. Additionally, the mold cavity shape may be chosen either for additional processing to form a final desired component, or the mold cavity may have a shape that is appropriate to provide a final net shaped part. For example, in one embodiment, a mold cavity may be shaped to form an array of conical emitter bodies disposed on a flat rectangular prism that acts as a substrate for the emitter bodies. Of course, while the mold cavity may have any appropriate shape, as detailed above, the mold cavity may also have a ratio of volume to exposed surface area, or other appropriate ratio, that when coupled with the other processing parameters of the solution form a sol-gel provide a desire mean pore radii and/or porosity.

After providing a mold, the solution is then placed into the mold cavity at 6 using, for example, pouring, syringes, piping, automated dispensing systems, or any other appropriate method. After placing the solution into the mold cavity, the solution is permitted to cure for an appropriate time period at 8 to form a sol-gel. During the curing process, pore clusters of a desired size and density are formed throughout the material due to the interaction of the mold cavity characteristics and other processing parameters as described further in the examples below. The cured sol-gel is then removed from the mold cavity at 10. The sol-gel is then dried at 12 to form either an aerogel or xerogel depending on the particular type of sol-gel and drying process used. The drying process may either be conducted at ambient conditions, elevated temperature, under supercritical drying conditions, or any other appropriate type of drying conditions. Of course, the particular temperatures, pressures, and durations used to dry the sol-gel will depend on the particular materials being used.

After forming an aerogel or xerogel, in some embodiments, the resulting porous material may then be subjected to additional steps. For example, as shown at 14, the porous material may be pyrolized at an elevated temperature under an inert atmosphere for a sufficient duration to turn the material into a porous carbon material. Subsequently, one or more thermal cycles may be applied to the porous carbon material to reduce the thermal expansion hysteresis of the material at 16, and as described previously above.

Other post processing and formation techniques may also be applied to the resulting material at 18. In one such embodiment, a skin formed on the surface of the porous carbon material corresponding to the exposed portion of the mold cavity, may be removed using an appropriate machining process such as grinding, filing, mechanical polishing, chemical etching, laser etching, micromilling, electrical discharge machining (EDM), or any other appropriate method. The porous carbon material may also be subjected to both additive and subtractive processes such as molding and/or three dimensional printing processes of the sol gel prior to curing as well as post processing techniques such as grinding, filing, mechanical polishing, chemical etching, laser etching, lithography, micromilling, electrical discharge machining (EDM), or any other appropriate formation process as the disclosure is not so limited. After appropriately forming the porous carbon material, the final porous carbon material may be assembled with one or more components to form a device at 20. For example, as described further below, the porous carbon material may be formed into one or more emitter bodies that are then assembled with a substrate for inclusion in a device. The porous carbon material may be bonded to the substrate through any appropriate bonding process (e.g. thermal bonding, adhesive, compression using a frame, etc.). Alternatively, in some embodiments, the desired features, such as the emitter bodies, may be formed into a larger amount of the porous carbon material forming the substrate such that they are monolithically formed together.

Figure 2:
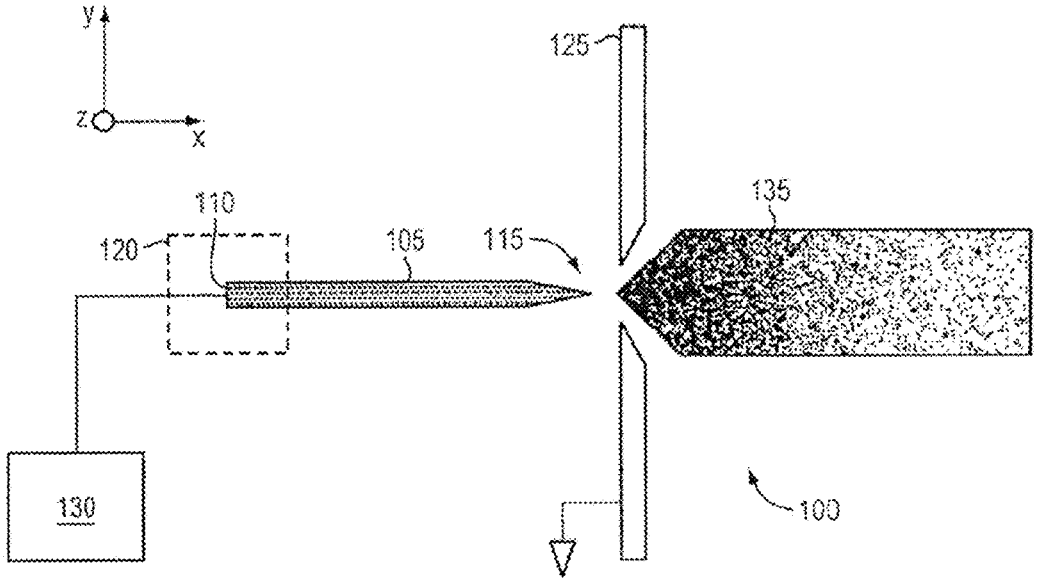
FIG. 2 is a schematic representation of an ion emitter.

FIG. 2 depicts an ion emitter 100 including an emitter body 105 that includes a base 110 and a tip 115. The emitter body may be microfabricated from a porous carbon material as described herein and is compatible with at least one of an ionic liquid or room-temperature molten salt located in a source of ions 120. The ion source is in fluid communication with the base of the emitter so that the ionic liquid is transported through capillarity from the base to the tip of the emitter body. Depending on the particular embodiment, the ion source may either be in direct contact with the base of the emitter body, or it may be in indirect fluid communication with the base of the emitter body through an intermediate porous component such as a porous substrate or other structure. In either case the ionic liquid or molten salt may be continuously transported through capillarity from the base 110 to the tip 115 so that the ion source 100 (e.g., emitter) avoids liquid starvation.

As also illustrated in the figure, an electrode 125 may be positioned downstream relative to the body 105 and a power source 130 may apply a voltage to the body 105 relative to the electrode 125, thereby emitting a current (e.g., a beam of ions 135) from the tip 115 of the body 105. In some embodiments, the application of a voltage causes formation of a Taylor cone (e.g., as shown in FIG. 1) at the tip 115 and the emission of ions 135 from the tip 115.

Figure 3:
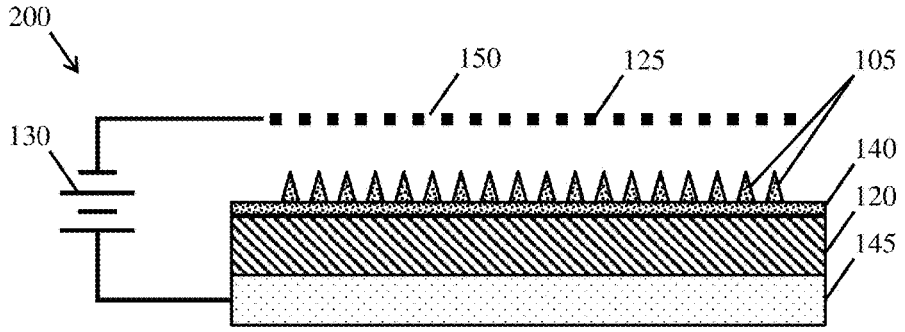
FIG. 3 is a schematic representation of an array of ion emitters.

While the above embodiment is directed to an ion emitter including a single emitter body, in some embodiments, a plurality of emitter bodies (e.g., an array of emitters) may be used in either a one dimensional or two dimensional array. For example, FIG. 3 depicts one embodiment of an electrospray emitter array 200. In this embodiment, the ion source includes an emitter array including a plurality of emitter bodies 105. Similar to the above, the plurality of emitter bodies may be formed from a porous carbon material using any appropriate fabrication technique to form the bodies themselves. The array of emitter bodies is disposed on a substrate 140, and may either be bonded to the substrate or integrally formed with the substrate as the disclosure is not so limited. The substrate is disposed on, and in fluid communication with a source of ions 120 such that the plurality of emitter bodies are also in fluid communication with the source of ions through the substrate. For example, the substrate may be porous and made from a material that is compatible with the ion source such that the array of emitter bodies is in fluid communication with the source of ions. Further, given the porosity of the emitter bodies themselves, the source of ions may be transported through the substrate and to the tips of the emitter bodies through capillarity (i.e. through capillary force). While a direct fluid communication between the source of ions and the substrate has been depicted, it should be understood that other intermediate components may be located between the substrate and ion source such that they are in indirect fluid communication as the disclosure is not so limited.

Similar to the prior embodiment, an extractor electrode 125 is located downstream from the emitter bodies 105 with one or more holes 150 formed in the electrode 125 and aligned with the corresponding tips of the emitter bodies. A power source 130 is in electrical connection with a downstream electrode 145 that applies a voltage to the ion source relative to the extractor electrode. Once a potential has been applied between the electrodes, the emitter bodies may emit a current from their tips.

In the above embodiments, electrodes associated with the source of ions have been depicted as being in electrical contact with the emitter bodies through the ion source. Without wishing to be bound by theory, this may help to prevent degradation of the electrodes during use. However, it should be understood that embodiments in which an electrical current is applied directly to the substrate and/or to the emitter bodies themselves are also contemplated as the disclosure is not so limited.

In the above noted embodiments, an ion source may include any appropriate material that is compatible with the materials of the emitter bodies, substrates, electrodes and other components that is capable of being emitted as an ion using either electrical and/or negative electrical potentials. For instance, an ion source may include materials such as ionic liquids and/or room-temperature molten salts. Examples of several appropriate materials include, but are not limited to, the imidazolium family including materials such as EMI-$BF_4$ (3-ethyl-1-methylimidazolium tetrafluoroborate), EMI-IM (1-ethyl-3-methylimidazolium bis(trifluoromethylsulfonyl)imide), BMI-$BF_4$, BMI-I, EMI-N$(CN)_2$, EMI-N$(CN)_3$, EMI-$GaCl_4$, EMIF2.3HF, as well as any other appropriate material.

Example: Materials and Synthesis

Figure 4:
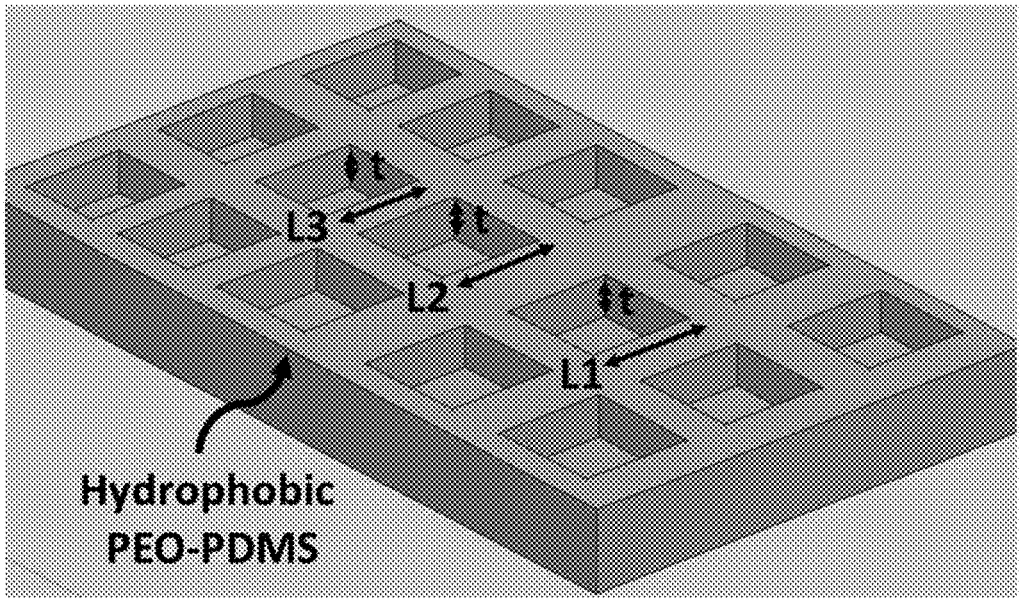
FIG. 4 is a schematic representation of a mold used to test materials made with different ratios of exposed surface area to volume ratios.

To test the effects of varying the exposed base surface area of a mold cavity, a mold including an 3 by 7 array of different sized cavities was manufactured. As shown in FIG. 4, cavities having the same thickness t but different side lengths, e.g. L1, L2, and L3, where formed in a hydrophobic polyethylene oxide-polydimethylsiloxane (PEO-PDMS) block. In these particular experiments, constant thickness samples with varying side lengths were formed for mold cavities to provide the different ratios provided below.

A sol-gel was formed using resorcinol (2.46 g, 0.112 mol) which was completely dissolved in water (3.00 g), followed by the addition of 37% formaldehyde solution (4.30 g, 0.054 mol). After mixing for five minutes (covered with parafilm to avoid evaporation), acetic acid (0.088 g, 1.5 mmol) was added to the solution. While any appropriate catalyst might be used, in these experiments, an acid catalyst (acetic acid) was used to permit gelation to take place at room temperature. The final mixture was then transferred to the hydrophilic PEO-PDMS mold which was then located in a sealed container. Without wishing to be bound by theory, during the subsequent reaction, the already-dissolved resorcinol reacts with formaldehyde to form hydrox-ymethylated resorcinol. Next, the hydroxymethyl groups condense with each other to form nanometer-sized clusters, which then crosslink by the same chemistry to produce a gel. This particular gel is typically referred to as an RF gel. In addition to the mold cavity geometry, the formation of clusters may also be influenced by typical sol-gel parameters such as temperature, pH, and concentration of the reactants.

Figure 6:
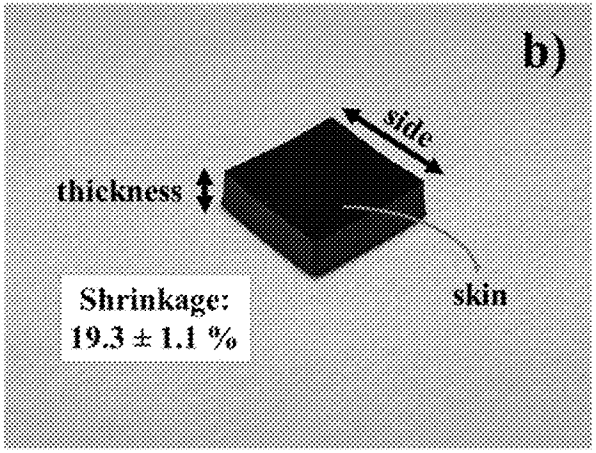
FIG. 6 is a micrograph image of the sol-gel of FIG. 5 after drying and pyrolization to form a carbon xerogel.
Figure 5:
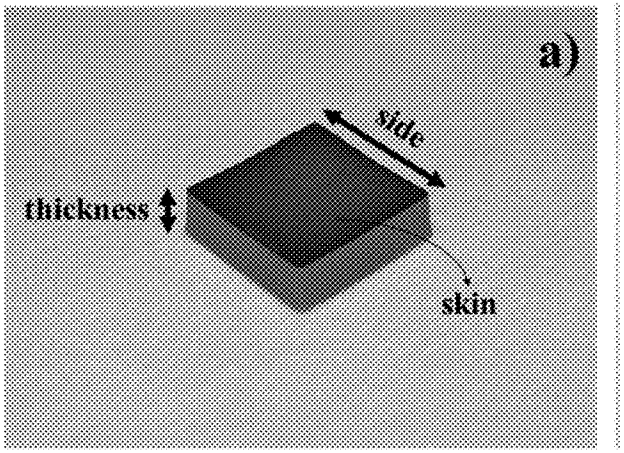
FIG. 5 is a micrograph image of a sol-gel with a skin formed on it prior to drying.
Figure 7:
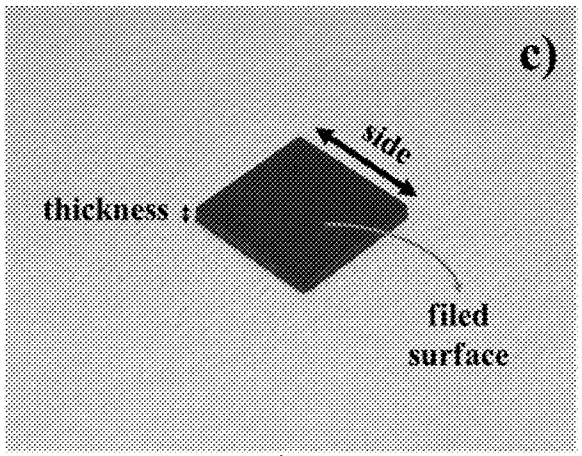
FIG. 7 is a micrograph of the carbon xerogel of FIG. 6 after removal of the skin.

After being placed in the mold cavities, the samples were cured at ambient temperature for 18 hours (gelation). They were then aged at 40° C. for 6° C., 60° C. for 18 hr, and 80° C. for 30 hr (drying). The final cured substrate is shown in FIG. 5. As seen in the figure, the material includes a skin on the portion of the material exposed at the upper surface of the mold cavity during curing. Thermal activation of the resulting porous material was then conducted which involved the controlled burn off of carbon from the network structure in an argon atmosphere. Without wishing to be bound by theory, this results in the development of new micropores and mesopores as well as opening of closed porosity in the xerogel framework. In these experiments, the activation process was selected so that the organic material was also carbonized. The specific pyrolization parameters were 1100° C. under flowing argon at 400 sccm. An image of the sample after pyrolysis is presented in FIG. 6. A shrinkage of 19%±1.1% was observed in the formed material. After pyrolization, the samples were then subjected to a filing process to remove the surface skin, see FIG. 7. Shaping and polishing for subsequent testing was then conducted using micro finishing discs with roughnesses of 5 nm and 8 nm.

Example: Mean Pore Radii Versus Depth

Figure 8:
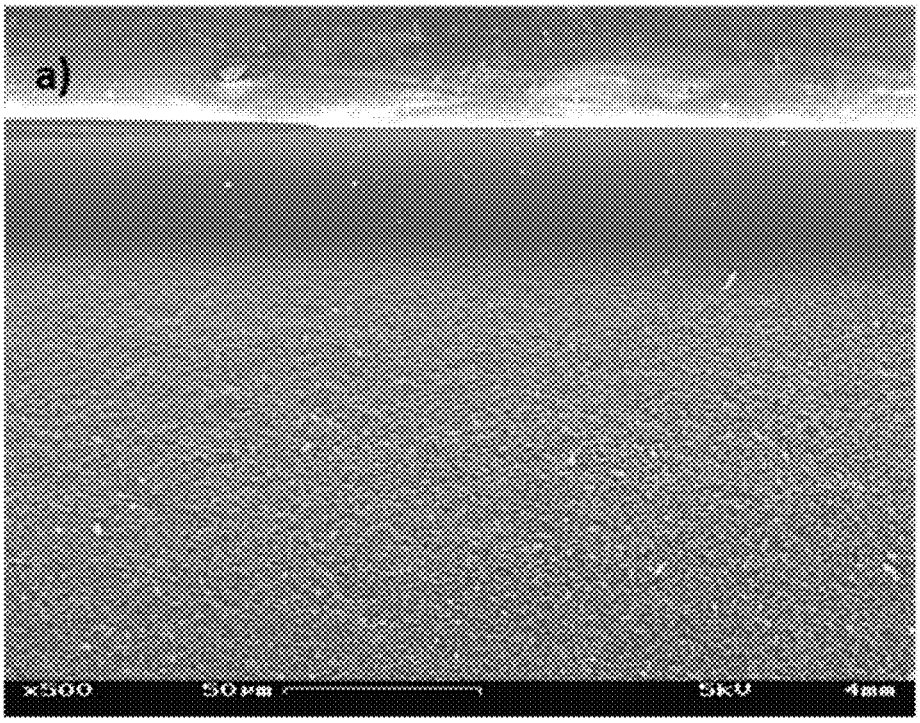
FIG. 8 is a scanning electron micrograph of a pyrolized porous carbon material.
Figure 9:
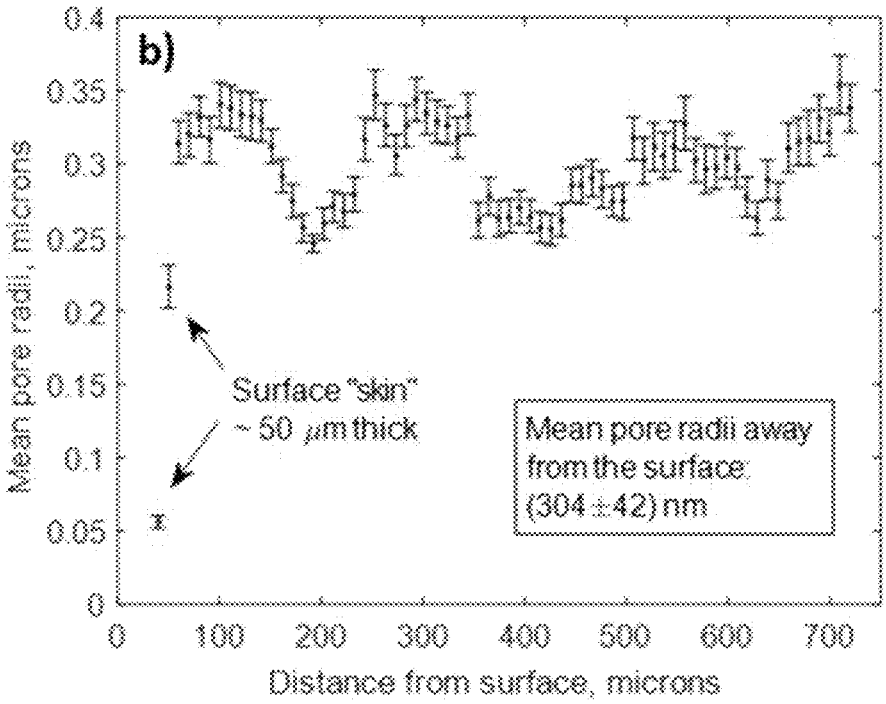
FIG. 9 is a graph of the mean pore radii versus distance from the exposed surface of the pyrolized porous carbon material of FIG. 8.

The final substrates showed a surface "skin" with a much higher density and smoother surface. This characteristic of RF xerogels had previously been observed. The cross section of a sample is shown in FIG. 8. As shown in the figure, there is a visible skin that is approximately 50 μm thick. FIG. 9 presents a graph of mean pore radii as a function of distance from the porous carbon material surface. To take these measurements, the scanning electron micrograph of FIG. 8 was analyzed using a cross section every 10 μm for a total of 750 μm. Excluding the skin region, the measured mean pore radii was 304±42 nm. The pore size was measured for each sample in two ways. First, each substrate was submerged in isopropanol and nitrogen was injected into them ("bubble test"). By equating the pressure at which bubbles emerged from the sample to the Young-Laplace pressure (assuming hemispherical bubbles on detachment) a value of mean-pore-radii was found. Second, the samples were analyzed under a Hitachi TM3030Plus Tabletop Scanning Electron Microscope. The images were then studied with an image processing software to determine the mean-pore-radii.

Without wishing to be bound by theory, during gelation, the influence of a mold surface creates a higher concentration of catalytic molecules (i.e. acetic acid molecules in this case) at the surface. This causes a higher reaction rate at the surface which results in the formation of inhomogeneities in the nanometer range forming the skin. If the boundary is instead between the gel and the environment (i.e. sol-air surface), then these molecules may account for hundreds of nanometers of the sample's thickness. In this part of the xerogel, the gelation is enhanced due to evaporation, and therefore a more effective RF deposition can take place, leading to a rather denser skin.

Example: Pore Size Range

Figure 10:
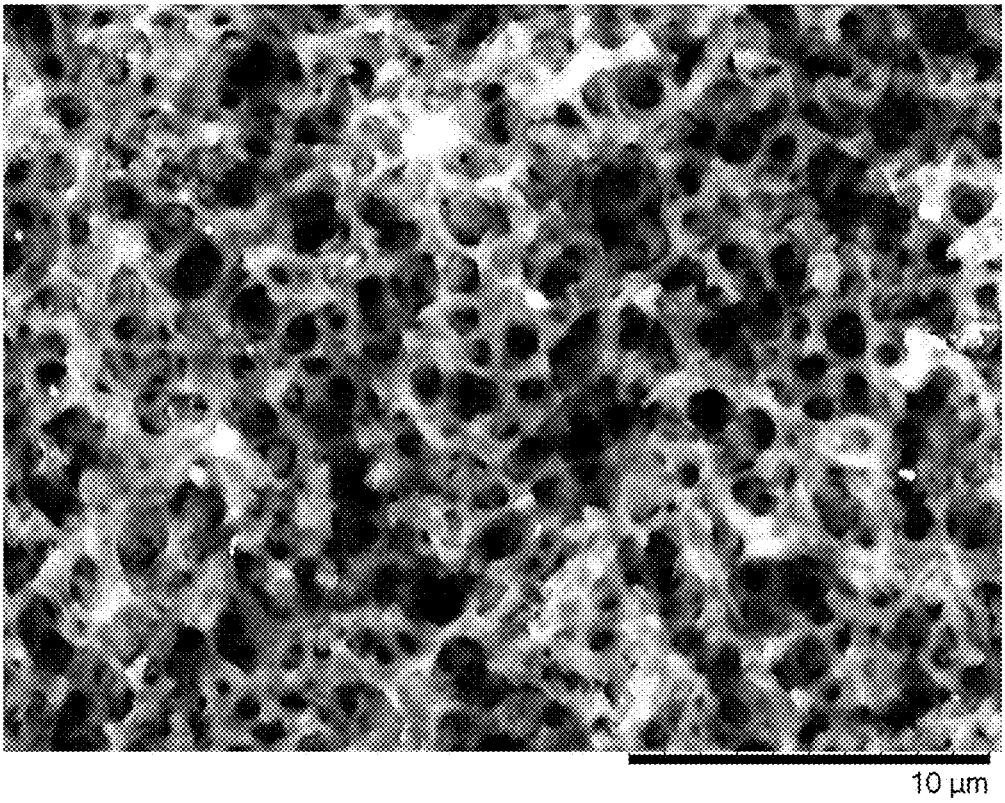
FIG. 10 is a scanning electron micrograph of a pyrolized porous carbon material.

FIG. 10 is a scanning electron micrograph of the pores present in a resorcinol-formaldehyde sample formed using the methods described herein. As illustrated in the figure, the sample has pores with radii between the mesoporous and macroporous categories ranging from about 300 nm to 700 nm. Thus, the process is capable of controllably producing pores that are not practical to create using other more typical methods. Further, it is expected that the described variable ranges may be extended to enable the production of materials with mean pore radii in the range from about 10 nm to 1 μm.

Example: Mean Pore Radii vs Ratios

A total of over 100 resorcinol-formaldehyde (RF) substrates were produced and analyzed using the above noted pore size measurement techniques. As expected, both tests gave agreeable results. The values shown in Table 1 correspond to the mean of the results from these two tests. The mean pore radii range between about 320 nm and 705 nm and vary with the ratio of the exposed surface area to volume and side length to depth of the molds. This data demonstrates that the pore size is dependent on the geometry of the mold cavity.

TABLE I

| Ratio (Side to Depth) | Ratio (Exposed Surface area:Volume) | Number of Samples | Mean pore radii (nm) | Standard Deviation |
|---|---|---|---|---|
| 3.33 | 11.09 | 22 | 321 | 48 |
| 3.36 | 11.29 | 22 | 376 | 51 |
| 3.40 | 11.56 | 22 | 450 | 45 |
| 3.44 | 11.83 | 15 | 498 | 43 |
| 3.48 | 12.11 | 15 | 573 | 52 |
| 3.51 | 12.32 | 10 | 627 | 46 |
| 3.55 | 12.60 | 10 | 704 | 50 |

In the above table, the standard deviation values shown were derived from a statistical analysis approximation of the deviations from both the bubble test and the SEM images.

The results in the above table demonstrate that samples mean-pore-radii were dependent on mold geometry. Further, and without wishing to be bound by theory, the diffusion rate at which this material moves to the surface appears to have a constant flux. As a result, gelling (or evaporation) takes place at a constant rate and the temperature and time at which the samples are gelling may also be an influence. Thus, this variation in pore size due to mold geometry was found to be related to the skin mentioned above. When the evaporation area is greater, the skin is thicker, and therefore the concentration of molecules in the bulk of the material decreases (more molecules become part of the skin)—causing a larger internal void space (larger pores). Similarly, if the evaporation area is smaller, the skin is still present but thinner, and thus the concentration of molecules in the bulk of the material is higher (smaller pores) consistent with the results presented above.

Example: Tailoring of Thermal Expansion Properties

Figure 11:
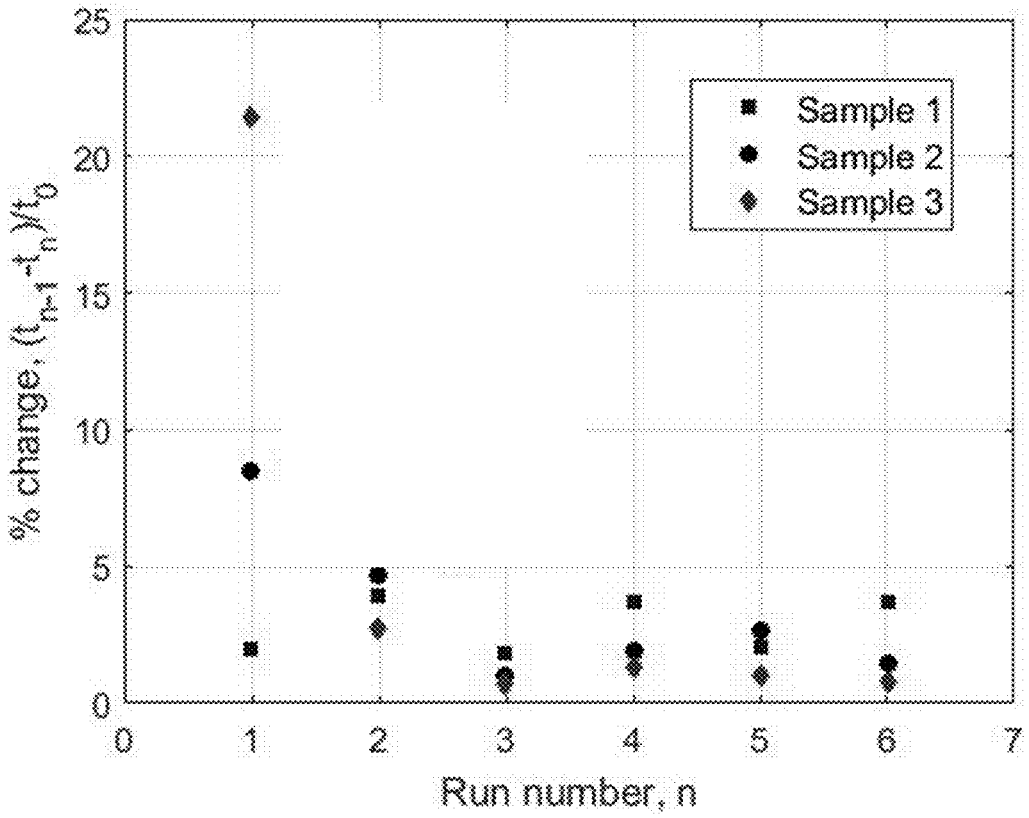
FIG. 11 is graph of material shrinkage after different numbers of thermal cycling.

For carbon xerogels after pyrolysis, thermal expansion curves between heating and cooling phases have a very noticeable discrepancy. Hysteresis in these curves may be problematic when coefficients of thermal expansion need to be matched. This characteristic of resorcinol-formaldehyde (RF) led to the fracture of approximately half of the samples while being utilized for specific applications that required changes in temperature. To mitigate this issue, carbon samples were taken to 430° C. (in steps of 110° C., 295° C. and 430° C. The samples were held for 10 min, 30 min, and 30 min respectively prior to being cooled down to ambient temperature a total of six times. The samples thermal expansion hysteresis was measured for each thermal cycle. The results for three samples are shown in FIG. 11. After the first cycle, these samples (which had no particular difference between them) had a percentage change in thickness of 21.4%±0.2%, 8.5%±0.2% and 2.0%±0.1%. This large inter-sample variability and large observed thermal expansion hysteresis in some of the samples explains why fractured RF samples were randomly observed after exposing them to temperature changes while bonded to other materials. For the second cycle, the samples' thicknesses changed about 3.7%±1.0%. After the second cycle, though, an almost constant—and relatively small thermal expansion hysteresis was observed of about 1.8%±0.7%.

Figure 12:
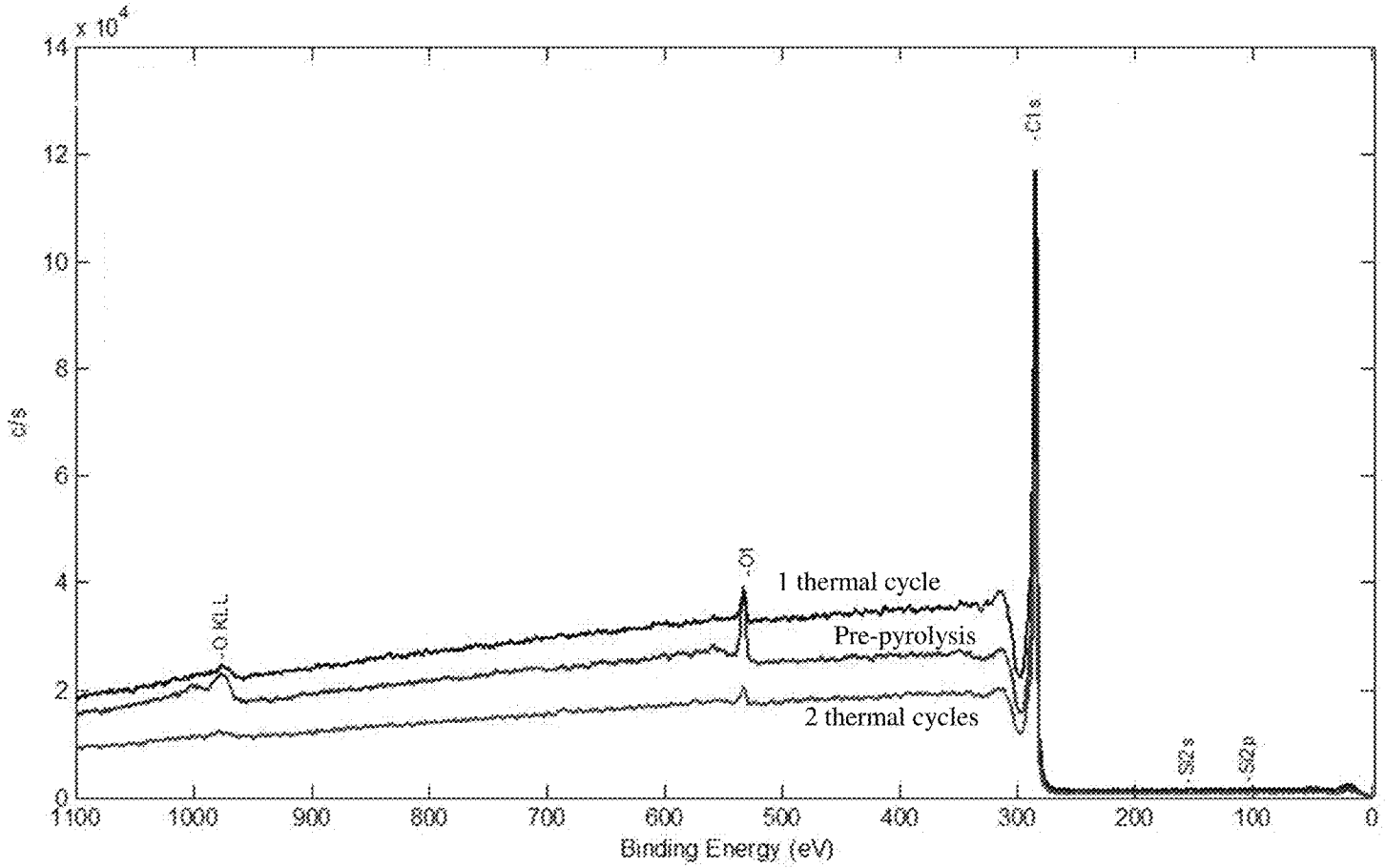
FIG. 12 is a graph of X-ray photoelectron spectroscopy (XPS) spectra for samples from FIG. 8 after different numbers of thermal cycles.
Figure 13:
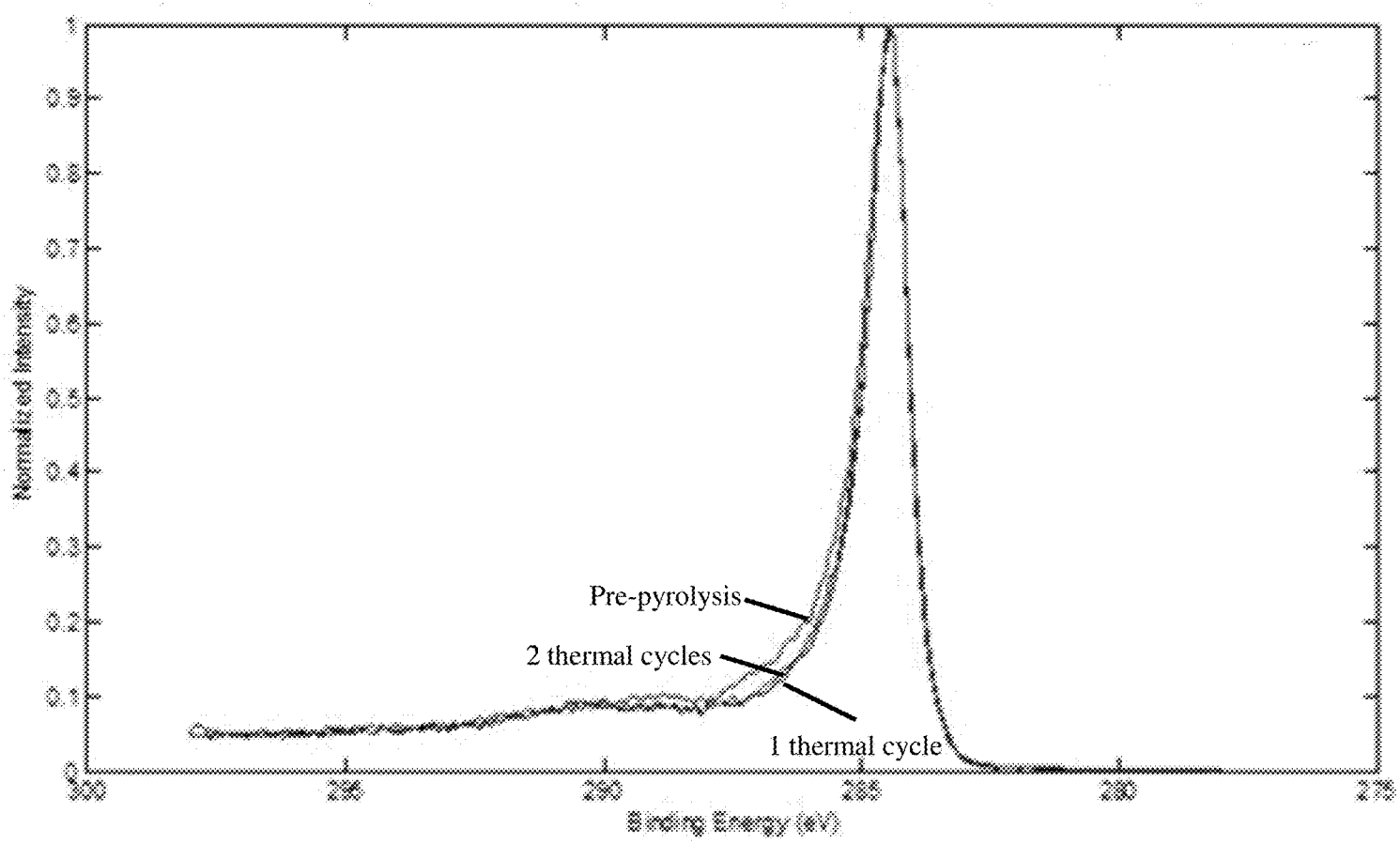
FIG. 13 is a graph of the XPS spectra of FIG. 12 from 300 eV to 275 eV.

In order to analyze the observed changes in thermal expansion hysteresis with increasing numbers of thermal cycles, the RF samples were characterized with x-ray photoelectron spectroscopy (XPS) between thermal cycles. XPS results from before pyrolysis, 1 thermal cycle after pyrolysis, and 2 thermal cycles after pyrolysis are shown in FIG. 12. FIG. 13 presents a high-definition image of the carbon peak of each sample. As seen in these figures, the C-1s band in the XPS spectra was observed for all three tests. The contribution at 284.5-284.6 eV can be ascribed to the presence of C—C bonds in graphitic carbon. A peak at 284.9-285.3 eV is related to the presence of defects in the graphitic structure of the carbon material. Whereas, peaks at 286.7 eV and 287.8 eV account for the presence of oxidized carbon, in the form of C—O and C═O species, respectively. These contributions corresponding to oxidized species is due to the use of acidic catalysts (acetic acid), leading to the presence of an important fraction of non-polymerized material which upon pyrolysis is mostly transformed into amorphous/disordered/defected carbon.

Without wishing to be bound by theory difference in concentrations of these oxidized carbons can be found by normalizing the three XPS data sets near the carbon peak (FIG. 4, magnified image). Since these species might appear as a separated "shoulder" or perhaps simply contribute to the C—C peak, then the difference in peak areas in the higher energy side of the C—C peak suggests a higher or lower concentration. In this case, it can be observed that for the first cycle (before pyrolysis), a higher concentration of C—O (or C—OH) and C═O species were present. After the first thermal cycle though, these concentrations substantially decreased. More quantitatively, before pyrolysis, the atomic concentrations for carbon and oxygen were 91.99% and 7.56%, respectively. After the first thermal cycle, these concentrations were 98.08% and 1.87%. After the second thermal cycle, 97.50% and 2.33% (no statistical differ-ence after cycle 1 and cycle 2). This change in oxygen concentration is explained by the fact that when the temperature starts decreasing after pyrolysis, some free hydroxyl radicals re-bond to the large carbon structures. After the first thermal cycle though, these radicals are eliminated causing the entire structure to shrink by different percentages between 2 and over 20% depending on the sample (FIG. 12). Again, this loss of hydroxyl radicals (from 7.56% to 1.87% of oxygen concentration) can be observed in both the oxygen peaks at higher binding energies, and in the maximized image of the carbon peak in FIG. 13.

Based on the above, the inventors recognized that the introduction of one or more thermal cycles after the synthesis of RF xerogels may improve their function by reducing the observed thermal hysteresis when the materials are assembled with another substrate or component.

Example: Ion Emitters Made with Porous Carbon Materials

As discussed above, porous carbon based on resorcinol-formaldehyde xerogels can be shaped to the desired micron sized geometry and can be controlled to have uniform pore sizes that are appropriate transport properties to favor pure ionic emission. Therefore, porous carbon based on resorcinol-formaldehyde xerogels was used to manufacture micro-tip emitters that were operated in the pure ionic regime (PIR) with no additional droplets. As detailed further below, time-of-flight mass spectrometry was used to verify that charged particle beams contain solvated ions exclusively.

A proof-of-concept carbon xerogel emitter was designed by choosing a tip geometry and substrate properties so that the emitter's hydraulic impedance will exceed $Z_{base}=1.5\cdot10^{17}$ kg $s^{-1}$ $m^{-4}$, which is the lowest impedance reported for which the PIR has been achieved with EMI-$BF_4$. The hydraulic impedance of a porous conical structure can be derived as a function of its height h, half-angle α, tip radius of curvature $R_c$, and substrate permeability κ and is given by:

$$Z = \frac{\mu}{2\pi\kappa}\frac{1}{1-\cos\alpha}\left(\frac{\tan\alpha}{R_c} - \frac{\cos\alpha}{h}\right) \quad (1)$$

where μ is the viscosity of the ionic liquid (0.038 Pa s for EMI-BF4). For high aspect ratio emitters (h/Rc>10), the impedance is governed by the first term of Eq. (1). Typical emitters used with ionic liquids have radii of curvature ranging between a few and tens of microns. For Rc=5 μm and α=20°, κ may be maintained below $10^{-13}$ $m^2$ to exceed the baseline impedance. The substrate permeability can be computed as a function of the pore size $r_p$ and porosity $\phi_p$ using the Kozeny-Carman formula and Glover's effective particle size calculation, and is given by $\kappa=r_p^2(60(1-\phi_p)^2)^{-1}$. For typical porosities between 0.4 and 0.6, the substrate may have pore radii below 1 μm to provide low enough permeability and achieve the target emitter impedance. Therefore, carbon xerogel tips were manufactured with half angles of about 20°, a radius of curvature on the order of 5 μm, and a mean pore radii of 1 μm or less.

Figure 14:
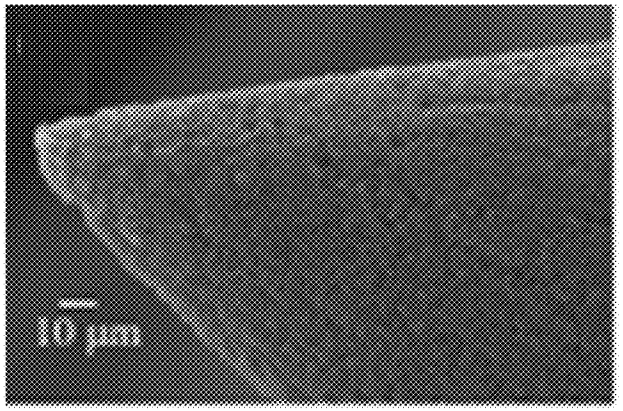
FIG. 14 is a scanning electron micrograph of a carbon xerogel emitter.
Figure 15:
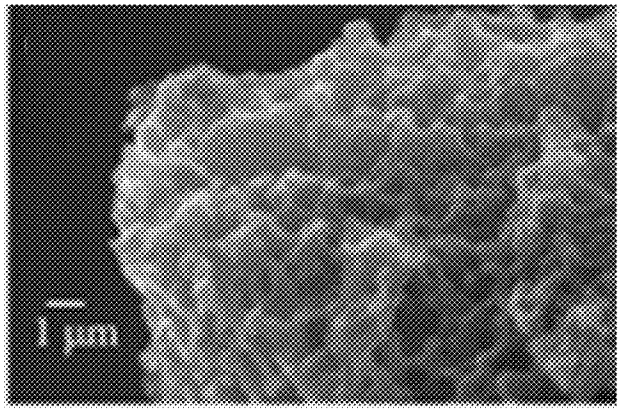
FIG. 15 is a higher magnification scanning electron micrograph of the carbon xerogel emitter of FIG. 14.

Emitters were fabricated by mechanical polishing the carbon xerogels. The starting material for the emitters was resorcinol formaldehyde xerogel synthesized using the procedures described herein. Specifically, the starting sol consisted of 24.6 g of resorcinol (Sigma Aldrich 99% purity) dissolved in 30 g of water and 35.8 g of formaldehyde 37% solution in water (Sigma-Aldrich). The crosslinking between the resorcinol and formaldehyde was catalyzed using 0.88 g of acetic acid (Sigma-Aldrich, purity 99%). The mixture was then poured into mold cavities, sealed, and allowed to gel at room temperature, 40° C., and 60° C. with a 24 hr duration at each temperature. The mold was then further cured at 80° C. for 72 hr. The molds were then opened and dried first at room temperature for 24 hr and then at 80° C. for 72 hr. To fabricate a microtip, a cylinder of resorcinol formaldehyde xerogel was mechanically polished to a conical shape with a 10° half-angle. The cone structure was subsequently pyrolyzed at 900° C. for 3 h under an argon atmosphere. The resulting material was a carbon porous network with pore diameters slightly below 1 μm, as estimated from scanning electron micrograph (SEM) images. For $\phi p=0.6$, the resulting permeability was $\kappa=3\cdot1014\ m^2$. At this point, some of the samples were blunt or contained foreign contamination. Therefore, the cones were polished once more and cleaned in ultrasonic baths of acetone and isopropanol to eliminate contamination. SEM images of the apex of a sample test emitter are shown in FIGS. 14 and 15. The resulting half-angle shown in the figure was closer to $\alpha=25°$ due to fabrication variations, and the estimated tip curvature was about 7 μm. With these values, the estimated impedance of the resulting emitters is about twice $Z_{base}$.

The emitter was prepared for emission by wrapping a platinum wire around the emitter to form a distal electrical contact. The platinum wire was electrically isolated from the emitter by using fiberglass located between the wire and emitter body. The emitter and distal contact were then immersed in a crucible of EMI-BF4 (Iolitec, 98% purity) under vacuum conditions (in order to eliminate residual water or other absorbed gases in the liquid and non-soluble gases trapped in the porous structure) before being installed in an experimental set-up for emission and time of flight (TOF) experiments.

Figure 16:
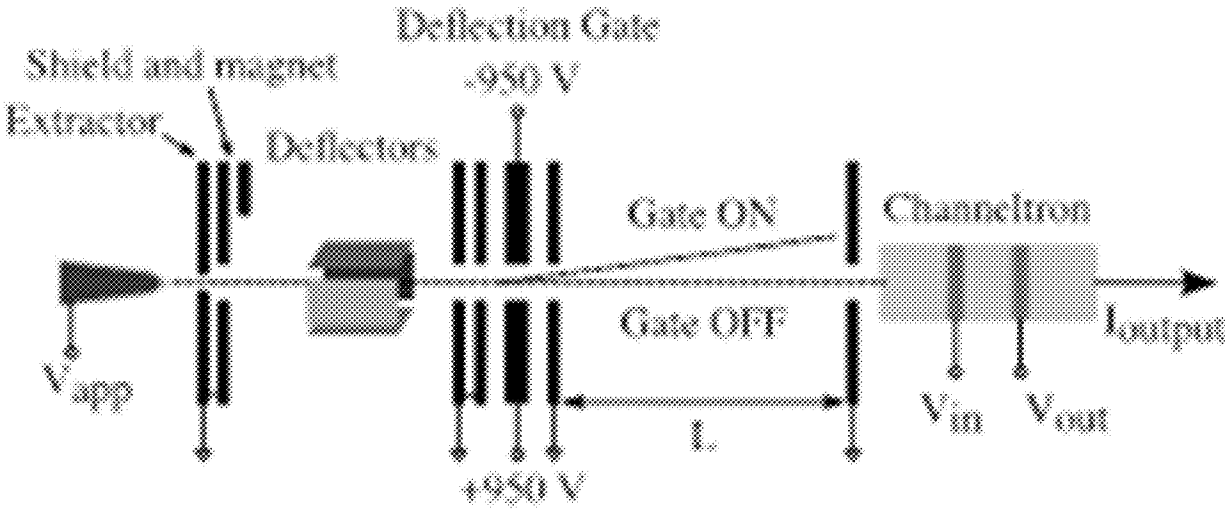
FIG. 16 is a schematic representation of an experimental setup used for testing carbon xerogel emitters.

FIG. 16 shows the experimental setup used for testing the emitter body. The wet emitter was centered about 1 mm in front of a grounded 1.6 mm diameter aperture on a stainless steel plate (the extractor), which was followed by another plate that acted as a shield. The shield supported a small magnet that helped to eliminate spurious signals from secondary electron emission resulting from ion beam impingement on the setup surfaces. The voltage applied to the distal electrode, $V_{app}$, was provided by a high voltage bipolar power supply, and the current emitted by the source, $I_{emitted}$, was measured by reading the voltage drop across a 1 MΩ resistor connected in series with the power supply. Both $V_{app}$ and $I_{emitted}$ were recorded using a computer at a frequency of 50 Hz. The TOF spectrometry setup consisted of a set of deflector plates, an electrostatic deflection gate, and a channeltron detector (Photonis Magnum 5900). To determine the composition of the emission, the gate periodically deflected the beam away from the channeltron. By measuring the time-of-flight t of the beam particles across the known distance L (set to 0.75 m), it was possible to find their charge-to-mass ratio q/m, assuming that their energy was equal to the applied voltage, from the following relationship:

$$t = L\sqrt{\frac{m}{2qV_{app}}} \tag{2}$$

The deflector plates consisted of two pairs of parallel planar electrodes 25.4 mm long and separated by approximately 1 cm. The planar electrodes can be used to stir the beam by biasing the plates to a few tens of volts. The gate consisted of several grounded apertures enclosing two electrodes of length 6.25 mm along the path of the beam, biased to 6950V, operated at a frequency of 500 Hz. The channeltron front was biased to Vin=−1.65 kV and the back was grounded (Vout=0 kV) to amplify the collected current signal, which was processed by an amplifier and recorded by an oscilloscope. All experiments were performed at pressures below 10-3 Pa and at a room temperature of 29° C. At this operating temperature, the conductivity of EMI-BF4 is close to 1.44 S/m (measured at 30 C). The liquid's surface tension at this temperature has not been measured, but at 23 C is 0.0452 N/m; in general, γ varies by less than 2% for similar ionic liquids in the range of 20-30 C.33

Figure 17:
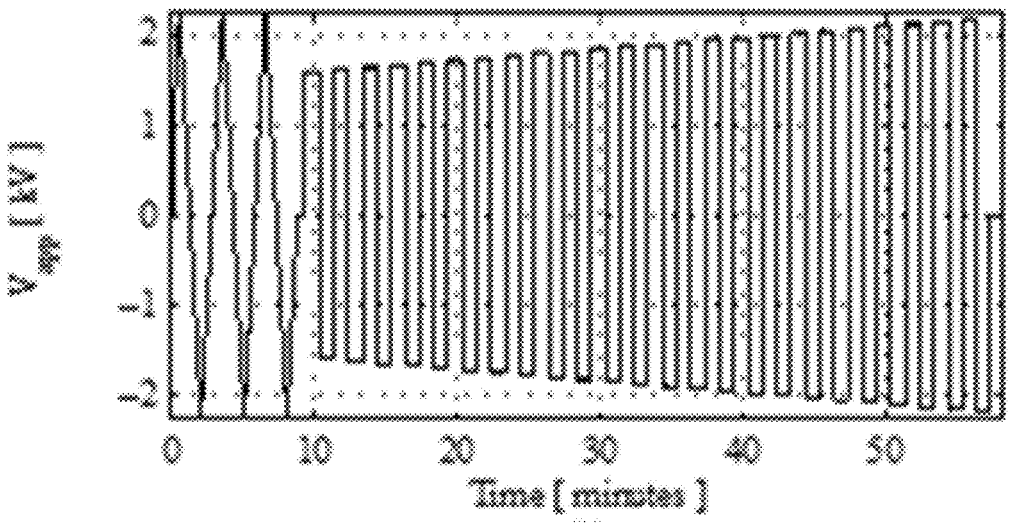
FIG. 17 is a voltage profile versus time for a carbon xerogel emitter.
Figure 18:
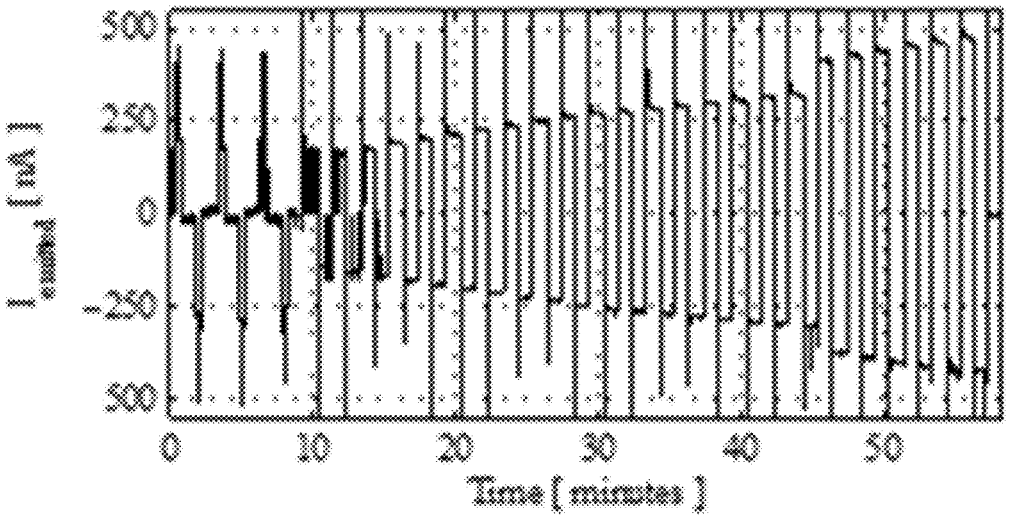
FIG. 18 is a matching current profile versus time for a carbon xerogel emitter for the voltage profile shown in FIG. 17.
Figure 19:
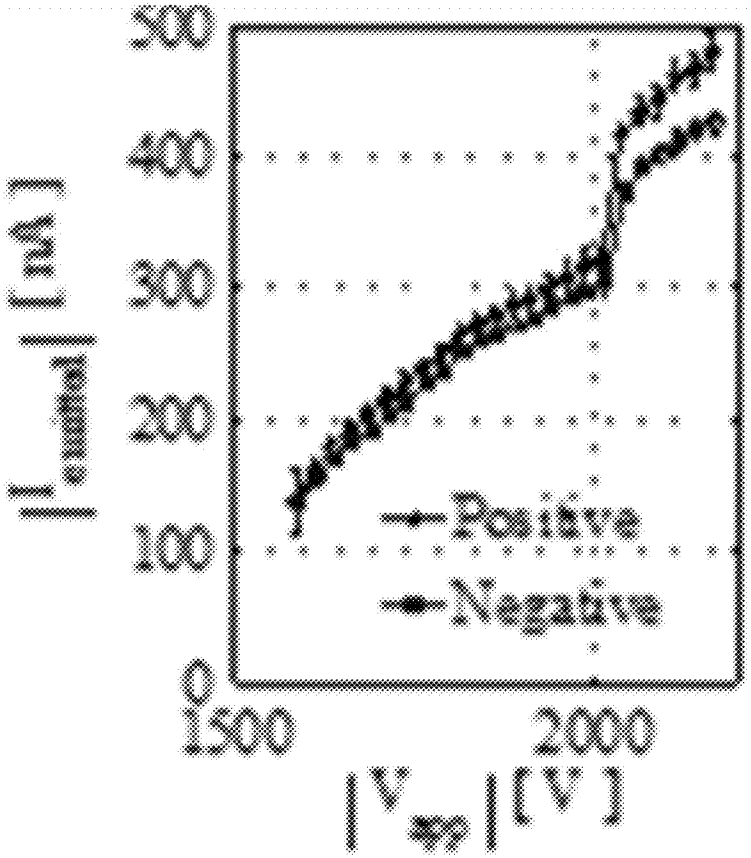
FIG. 19 is a current voltage profile for a carbon xerogel emitter.
Figure 20:
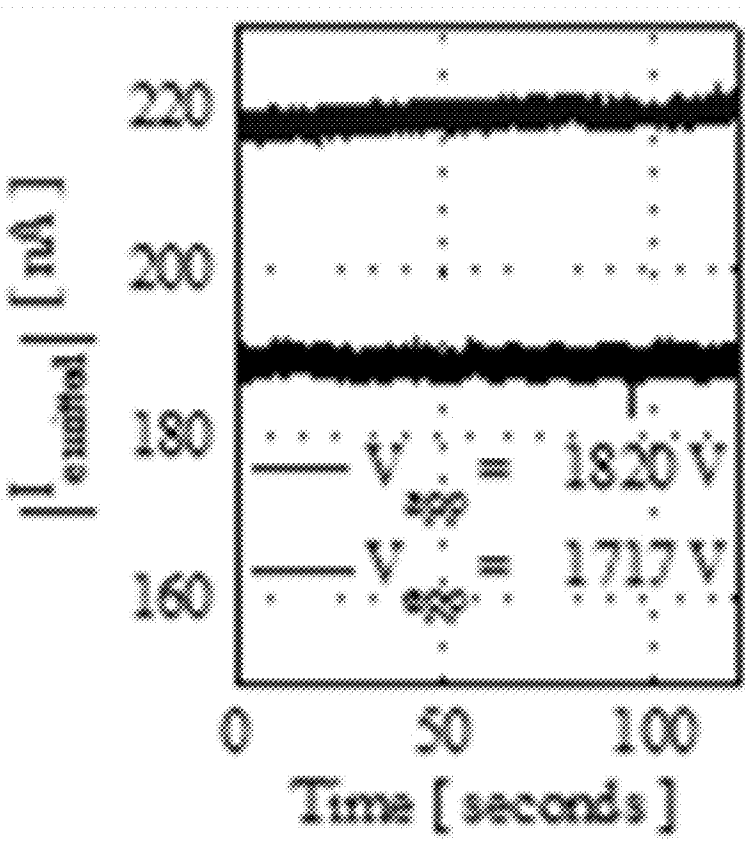
FIG. 20 is a graph of constant voltage operation for a carbon xerogel emitter.

Triangular voltage signals and alternating voltage ramps were applied to the distal contact to determine the source response. FIGS. 17 and 18 show a sample voltage signal and the corresponding emitted current. Emission occurred at a threshold voltage of ±1535 V for this particular implementation and the current levels were of the order of a few hundred nA, which is similar to the response from externally wetted emitters. FIG. 19 shows the average current for each of the voltages tested in the stepped ramp from FIGS. 17 and 18. As observable in the figures, there are three emission regimes for the tested ion source. First, the source emits intermittently at voltages close to the startup potential, as the electrostatic traction is insufficient for sustaining continuous emission. When $V_{app}$ is increased, the source emission becomes uninterrupted, showing an overshoot as the voltage is switched prior to reaching a stable current within a few seconds. This overshoot is also observed on externally wetted emitters. When $V_{app}$ is increased over a certain value (about 2000 V for this configuration), the current shows a clear step, which is consistent with the appearance of a second emission site supported farther upstream on the emitter apex. The source displays short-term stability in the intermediate voltage range. FIG. 20 shows 2-min intervals of operation of the source at positive and negative polarity. The variation of the current (standard deviation/mean) for these samples is less than 0.01, suggesting an adequate liquid supply to the emission site.

Figure 21:
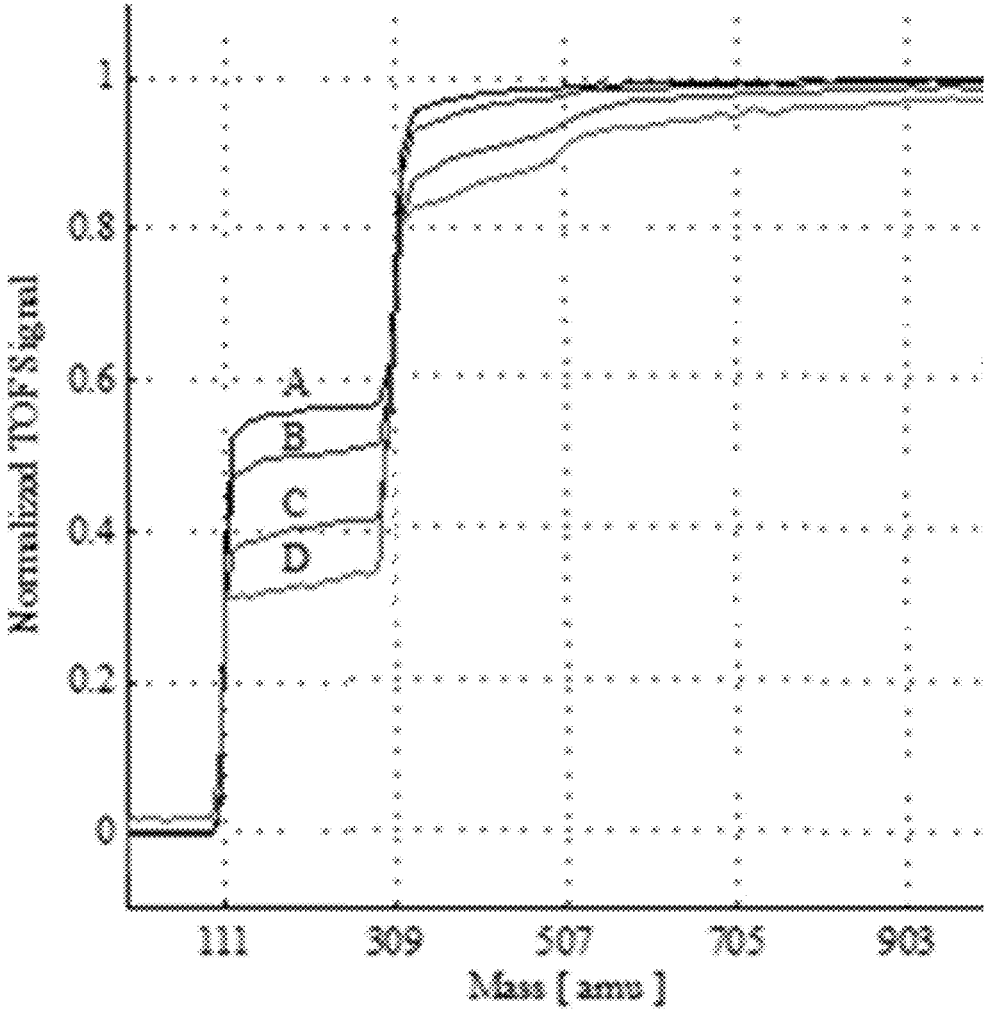
FIG. 21 is a graph of time-of-flight profiles for different locations over the cross section of a beam, curve A corresponds to the time-of-flight signal of maximum intensity in the scan.
Figure 22:
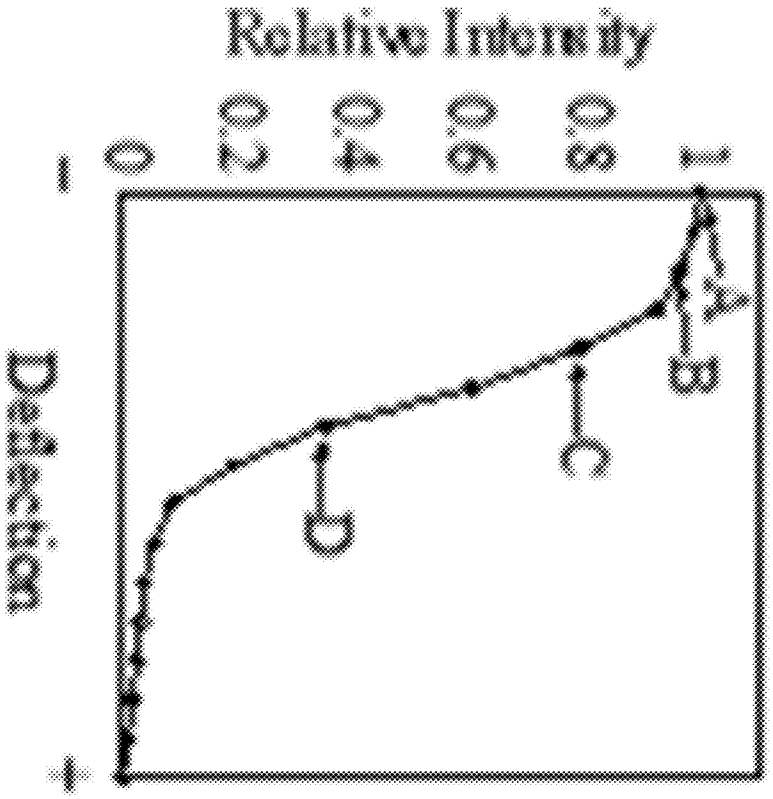
FIG. 22 is a graph of the beam current profile along a particular linear scan.

The deflector plates were biased to direct the beam towards the detector and perform a coarse scan in several directions, thus obtaining time of flight (TOF) data from several locations over the cross-section of the beam. FIG. 21 shows sample TOF traces obtained with the source operating at Vapp=1818 V. The relative intensities of the four signals are illustrated in FIG. 22. Each current signal was normalized to its own maximum for clarity and the time-of-flight axis was converted to mass units making use of Eq. (2) and assuming singly charged species. The current steps correspond closely to the mass of the ions EMI+, (EMI-BF4) EMI+, and (EMI-BF4)2EMI+ (111, 309, and 507 amu, respectively). The signal slopes in between the steps, and before the current reaches its maximum value, correspond to the results of the fragmentation of heavy ions (EMI-BF4) nEMI+ (n=1, 2, 3, . . . ) into neutrals and lighter ions, which have a fraction of their original kinetic energy. Other TOF traces on different beam sections and from experiments at different operating voltages (1718 V, 1768 V, 1869 V, and 1920 V) show the same behavior and none of the droplet tails that characterize the mixed regime.

In view of the above experiments, porous carbon materials can be synthesized using the disclosed methods with adequate morphologies for transport of ionic liquids and can be shaped into micrometer-sized tips from which emission can be obtained. These sources can also be designed to operate in the pure ionic regime with an ionic liquid such as EMI-BF4. This results demonstrates that it is possible to engineer the emitters to provide sufficient hydraulic impedance to operate in the pure ionic regime. Further, the robustness, ease of fabrication, and excellent uniformity of the resulting porous carbon material suggests that, in addition to tailored emitters for focused ion beam applications, arrays of emitters could be constructed for high-throughput applications such as space ion propulsion and DRIE. Additionally, the flexibility of modifying the substrate properties (e.g. mean pore radii and porosity) it is possible to adjust the emitter hydraulic impedance to engineer a desired flow rate of an ion source for a desired application.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. An ion emitter comprising:

a porous carbon emitter body; and a source of ions in fluid communication with the porous carbon emitter body, wherein a mean pore radii of the porous carbon emitter body is from 100 nm to 1 μm, and wherein a standard deviation of the mean pore radii is from 10 nm to 70 nm.

2. The ion emitter of claim 1, wherein a mean pore radii of the porous carbon emitter body is from 200 nm to 800 nm.

3. The ion emitter of claim 1, wherein the porous carbon emitter body is at least one of a carbon aerogel and a carbon xerogel.

4. The ion emitter of claim 1, wherein the porous carbon emitter body is disposed on a substrate.

5. The ion emitter of claim 4, wherein the porous carbon emitter body is monolithically formed with the substrate.

6. The ion emitter of claim 1, wherein a thermal expansion hysteresis of the porous carbon emitter body is less than or equal to 5%.

7. The ion emitter of claim 1, wherein the source of ions is an ionic liquid.

8. An array of ion emitters comprising:

a substrate;

a plurality of porous carbon emitter bodies disposed on the substrate; and a source of ions in fluid communication with the plurality of porous carbon emitter bodies through the substrate, wherein a mean pore radii of the plurality of porous carbon emitter bodies is from 100 nm to 1 μm, and wherein a standard deviation of the mean pore radii is from 10 nm to 70 nm.

9. The array of ion emitters of claim 8, wherein a mean pore radii of the plurality of porous carbon emitter bodies is from 200 nm to 800 nm.

10. The array of ion emitters of claim 8, wherein the plurality of porous carbon emitter bodies are at least one of a carbon aerogel and a carbon xerogel.

11. The array of ion emitters of claim 8, wherein the plurality of porous carbon emitter bodies are monolithically formed with the substrate.

12. The array of ion emitters of claim 8, wherein the plurality of porous carbon emitter bodies are bonded to the substrate.

13. The array of ion emitters of claim 8, wherein a thermal expansion hysteresis of the plurality of porous carbon emitter bodies is less than or equal to 5%.

14. The array of ion emitters of claim 8, wherein the source of ions is an ionic liquid.

15. A method of forming a porous carbon material comprising:

placing a solution into a mold cavity having a ratio of exposed surface area to volume from 10.5 to 13.5;

curing the solution to form a sol-gel;

drying the sol-gel to form a porous material; and pyrolyzing the porous material to form the porous carbon material.

16. The method of claim 15, wherein the sol-gel contains at least one of resorcinol formaldehyde, phenol formaldehyde, melamine formaldehyde, cresol formaldehyde, phenol furfuryl alcohol, polyacrylamides, polyacrylonitriles, polyacrylates, polycyanurates, polyfurfural alcohol, polyimides, polystyrenes, polyurethanes, polyvinyl alcohol dialdehyde, epoxies, agar agar, and agarose.

17. The method of claim 15, wherein the solution and ratio are selected to produce a mean pore radii in the porous carbon material from 100 nm to 1 μm.

18. The method of claim 17, wherein the solution and ratio are selected to produce a mean pore radii in the porous carbon material from 200 nm to 800 nm.

19. The method of claim 17, wherein a standard deviation of the mean pore radii is from 10 nm to 70 nm.

20. A material comprising:

a porous carbon having a mean pore radii from 100 nm to 1 μm, wherein a standard deviation of the mean pore radii is from 10 nm to 70 nm.

21. The material of claim 20, wherein the porous carbon is at least one of a carbon aerogel and a carbon xerogel.

22. The material of claim 20, wherein a thermal expansion hysteresis of the porous carbon is less than or equal to 5%.

23. The material of claim 20, wherein the porous carbon has a mean pore radii from 200 nm to 800 nm.

* * * * *